US010012468B1

(12) United States Patent
Kempf et al.

(10) Patent No.: US 10,012,468 B1
(45) Date of Patent: Jul. 3, 2018

(54) SELF-CENTERING ANTI-DRY FIRE DEVICE FOR A CROSSBOW

(71) Applicants: James J. Kempf, Coralville, IA (US); Rex E. Isenhower, Stanwood, IA (US)

(72) Inventors: James J. Kempf, Coralville, IA (US); Rex E. Isenhower, Stanwood, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 15/683,808

(22) Filed: Aug. 23, 2017

(51) Int. Cl.

| | |
|---|---|
| ***F41B 5/12*** | (2006.01) |
| ***F41B 5/14*** | (2006.01) |
| ***F21V 33/00*** | (2006.01) |
| *F42B 6/04* | (2006.01) |

(52) U.S. Cl.
CPC ..... *F41B 5/1469* (2013.01); *F21V 33/008* (2013.01); *F41B 5/12* (2013.01); *F42B 6/04* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 4,877,008 | A * | 10/1989 | Troubridge | F41B 5/1469 124/25 |
| 5,598,829 | A * | 2/1997 | Bednar | F41A 17/28 124/25 |
| 5,884,614 | A | 3/1999 | Darlington et al. | |
| 6,205,990 | B1 | 3/2001 | Adkins | |
| 6,736,123 | B1 | 5/2004 | Summers et al. | |
| 7,814,894 | B2 | 10/2010 | Giroux | |
| 8,602,013 | B2 * | 12/2013 | Bednar | F41B 5/12 124/25 |
| 9,097,485 | B2 * | 8/2015 | Lipowski | F41A 17/46 |
| 9,255,754 | B1 | 2/2016 | Kempf | |
| 9,523,549 | B1 * | 12/2016 | Hughes | F41B 5/12 |

* cited by examiner

*Primary Examiner* — John Ricci
(74) *Attorney, Agent, or Firm* — Donald J. Ersler

(57) ABSTRACT

A self-centering anti-dry fire device for a crossbow n improved crossbow lock mechanism assembly includes a trigger housing, a string latch, a seer lever, a combination arrow self-centering anti-dry fire and seer lock lever, a trigger and a safety slide bar. An arrow cavity is formed in a top of the combination arrow self-centering anti-dry fire and seer lock lever. A cross section of the arrow cavity may have a "V" shape, a curved shape, a notch shape or any other suitable shape. The arrow cavity ensures that the arrow shaft is centered relative to a centerline of a barrel of the crossbow.

15 Claims, 8 Drawing Sheets

SELF-CENTERING ANTI-DRY FIRE DEVICE FOR A CROSSBOW

BACKGROUND OF THE INVENTION

1. Field of the Invention

The present invention relates generally to archery and crossbows, more specifically to a self-centering anti-dry fire device for a crossbow. The disclosed anti-dry fire device automatically centers the arrow on the bow string when the archer loads the arrow into the crossbow.

2. Discussion of the Prior Art

U.S. Pat. No. 5,884,614 to Darlington et al. discloses a crossbow with improved trigger mechanism. U.S. Pat. No. 6,205,990 discloses a dry-fire prevention mechanism for crossbows. U.S. Pat. No. 6,736,123 to Summers et al. discloses a crossbow trigger. U.S. Pat. No. 7,814,984 to Giroux discloses a anti dry-fire device for crossbows. U.S. Pat. No. 9,255,754 to Kempf discloses a crossbow lock mechanism. U.S. Pat. No. 9,255,754 is hereby incorporated into this application by reference in its entirety. Centering of the arrow with the bow string is critical with relation to accuracy. It appears that the prior art does not teach or suggest an arrow self-centering device for a crossbow. Patent application Ser. No. 15/626,207 to Kempf et al. is hereby incorporated into this patent application by reference in its entirety.

Accordingly, there is a clearly felt need in the art for a self-centering anti-dry fire device for a crossbow, which includes an improved seer lock lever that automatically centers the arrow as the arrow is nocked into the string-holding latch of a crossbow.

SUMMARY OF THE INVENTION

The present invention provides a self-centering anti-dry fire device for a crossbow, which automatically centers the arrow when the arrow is loaded into the crossbow, and a nock is engaged with the string. A crossbow includes a riser, a barrel, two bow limbs, two cams, a bow string, a trigger housing and a stock. The stock is attached to one end of the barrel. The riser is attached to the barrel in front of the stock. The bow limbs extend from opposing ends of the riser. Each bow limb is terminated with one of the two cams. The bow string is retained on the two cams. The trigger housing is contained within the stock or barrel.

The self centering device for a crossbow includes the trigger housing, a seer lever, a seer lock lever, a string latch, a safety, and a trigger. A mechanism cavity is formed in the trigger housing to receive and retain the seer lever, the combination anti-dry fire and seer lock lever and the string latch. The upper surface of the combination anti-dry fire and seer lock device includes a recess, which provides the self centering feature of the present invention. The seer lever includes a seer base, an anti-dry firing projection, a latch projection, and an elongated pivot link. The anti-dry firing projection extends from one end of the seer base and the elongated pivot link extends from an opposing end of the seer base. The latch projection extends outward from a length of the seer base. One end of the elongated pivot link is pivotally retained in the mechanism cavity. An opposing end of the elongated pivot link is pivotally engaged with the trigger.

The trigger includes a trigger lever and a trigger link. An end of the trigger lever is pivotally retained on the barrel. One end of the trigger link is pivotally retained on the trigger lever, adjacent the trigger lever pivot point. The other end of the trigger link is pivotally retained on an opposing end of the pivot link. The string latch includes a latch base, an arrow shaft yoke, a seer notch and a spring projection. The arrow shaft yoke extends from one side of the latch base and the spring projection extends from an opposing side of the latch base at one end thereof. The seer notch is formed in an opposing end of the latch base. The string latch is pivotally retained in the mechanism cavity adjacent the spring projection. The seer notch engages the latch projection.

The seer lock lever includes a latch finger and an impact finger. The latch finger extends from one end of the seer lock lever and the impact finger extends from an opposing end of the seer lock lever. The latch finger is sized to capture the anti-dry firing projection. A seer lever stop extends outward from the mechanism cavity, above the seer base and between the anti-dry firing projection and the latch projection to stop excessive upward motion of the seer lever. A latch ball stop is preferably retained between the impact finger and the seer lever stop, but may have other suitable locations. A safety bar is slideably located to engage with the seer lever, so that when the safety bar is in a safe position, the seer lever is constrained from movement, and when the safety bar is in a fire position, the safety bar does not interfere with the movement of the seer lever.

In use, as the safety slide bar is moved from a fire position to a safe position, a spring loaded ball is received by a detent notch, which may create an audible sound. As the safety bar is moved from the safe position to a fire position, the spring loaded ball is forced into a spring pocket, compressing the spring, thus increasing pressure from the ball to the safety bar, however there will be virtually no audible sound when the safety bar reaches the fire position, as there is no movement of the spring loaded ball.

Additionally, the arrow self centering device may be independent from a seer lock lever.

Accordingly, it is an object of the present invention to provide an arrow self centering device, which automatically centers the arrow on the bow string, as the arrow is loaded and nocked to the crossbow string.

These and additional objects, advantages, features and benefits of the present invention will become apparent from the following specification.

DETAILED DESCRIPTION OF THE PREFERRED EMBODIMENTS

Figure 1:
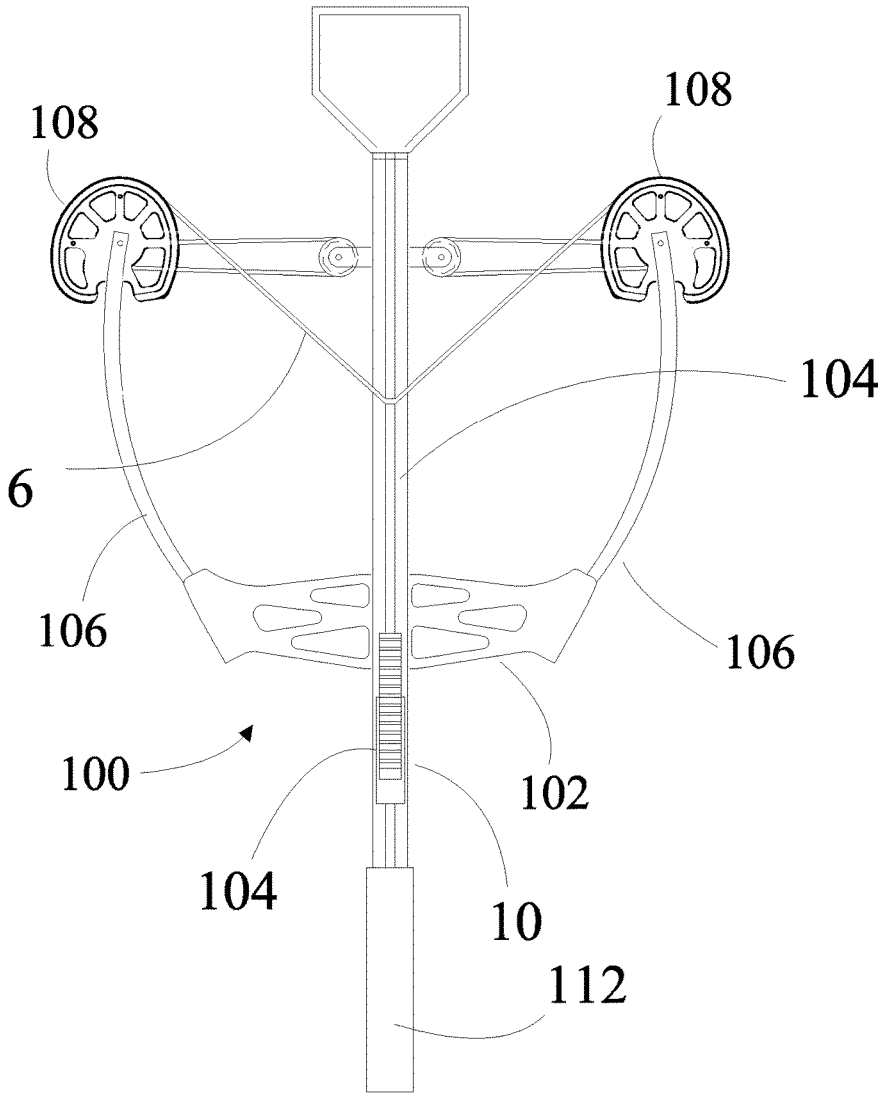
FIG. 1 is a top view of a crossbow including a self-centering anti-dry fire device in accordance with the present invention.
Figure 2:
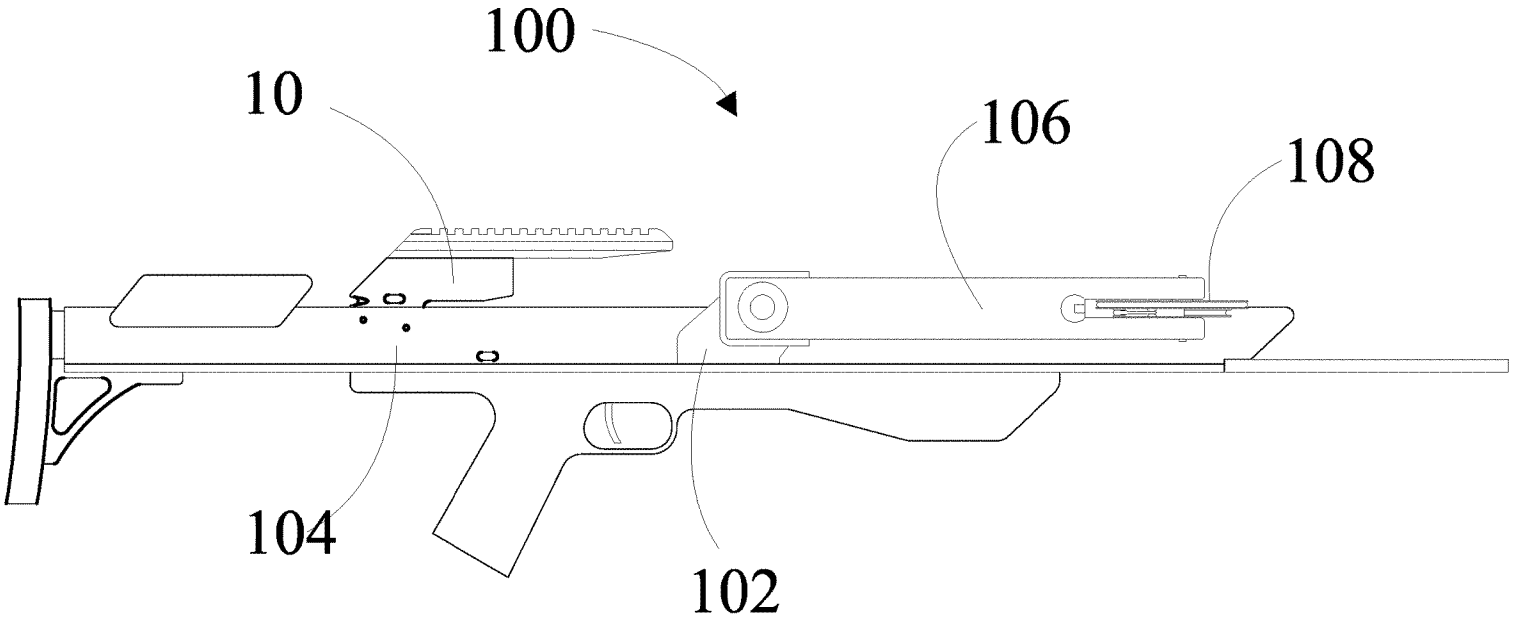
FIG. 2 is a side view of a crossbow with a cover removed for illustrating the self-centering anti-dry fire device in accordance with the present invention.
Figure 3:
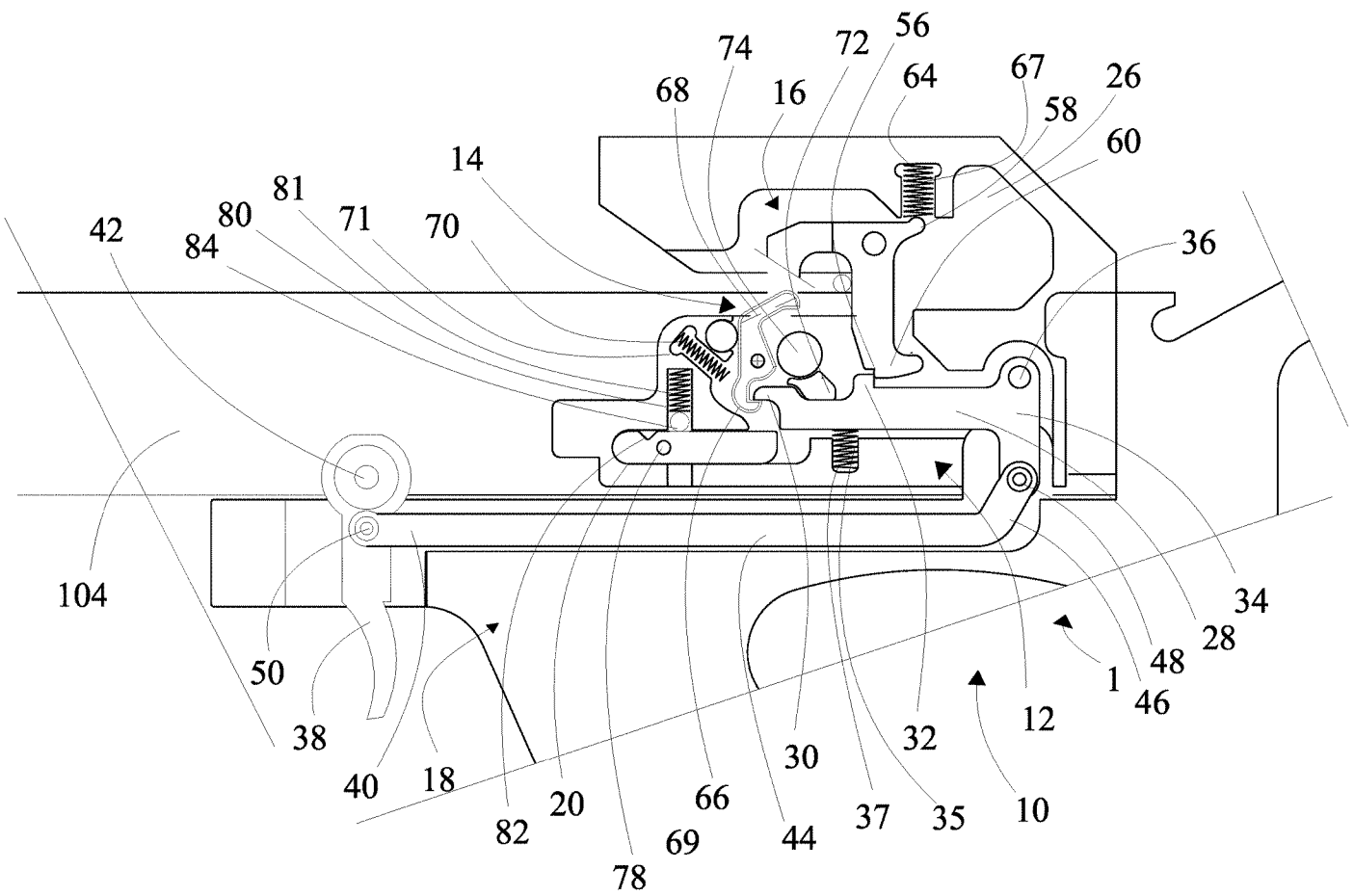
FIG. 3 is a side view of a self-centering anti-dry fire device for a crossbow with a cover removed in accordance with the present invention.
Figure 4:
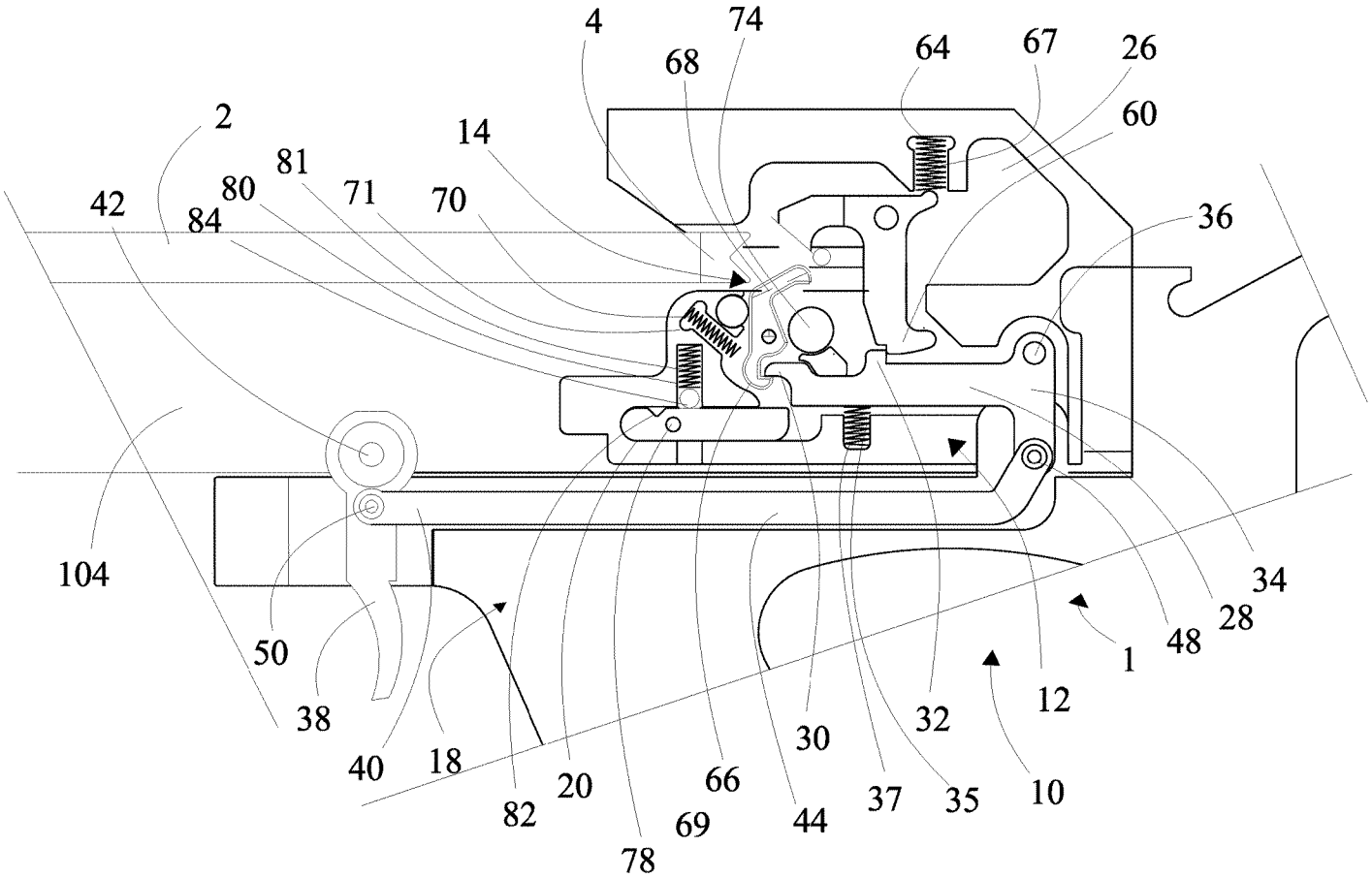
FIG. 4 is a side view of a self-centering anti-dry fire device for a crossbow with a cover removed, wherein an arrow is partially inserted, in accordance with the present invention.
Figure 4B:
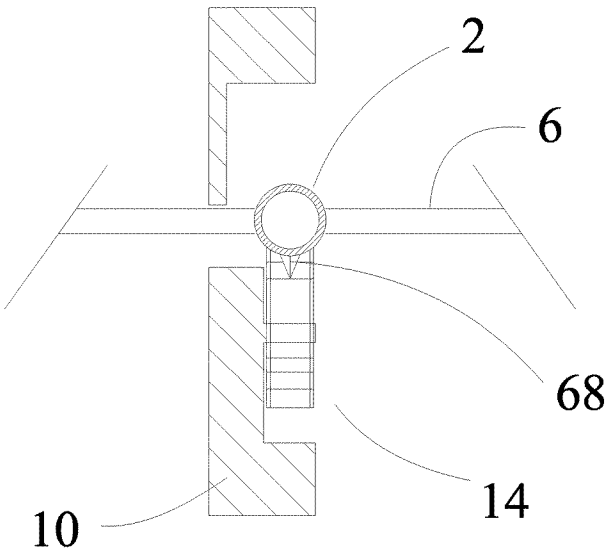
FIG. 4B is a cross section view of a self-centering anti-dry fire device for a crossbow, wherein an arrow is nearly engaged, in accordance with the present invention.
Figure 4A:
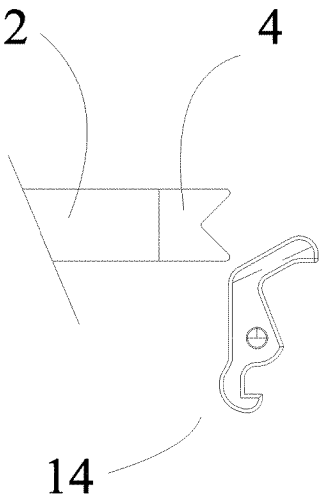
FIG. 4A is a side view of a self-centering anti-dry fire device for a crossbow, wherein an arrow is nearly engaged, in accordance with the present invention.
Figure 5:
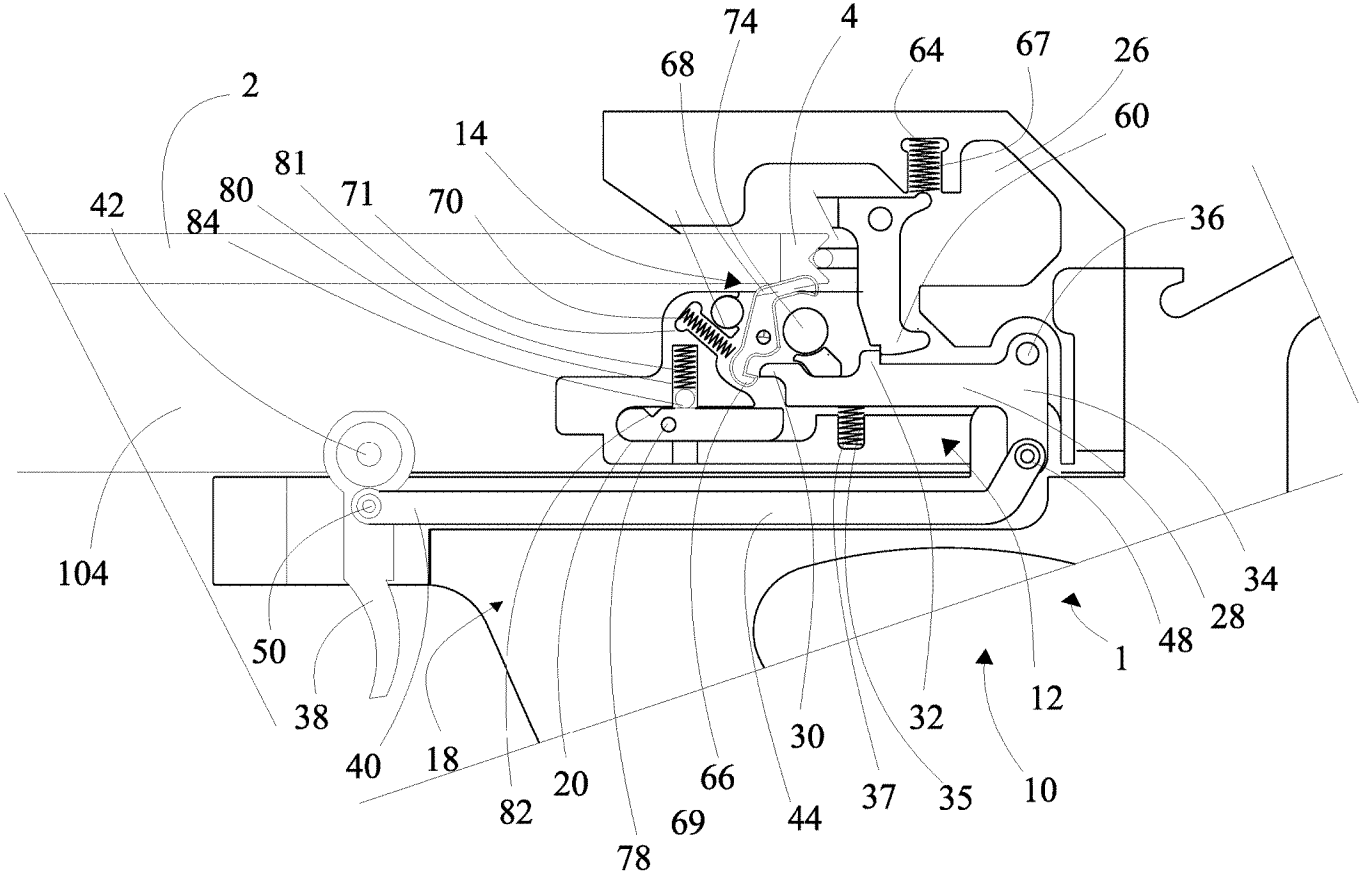
FIG. 5 is a side view of a self-centering anti-dry fire device for a crossbow with a cover removed, wherein an arrow is inserted, in accordance with the present invention.
Figure 5B:
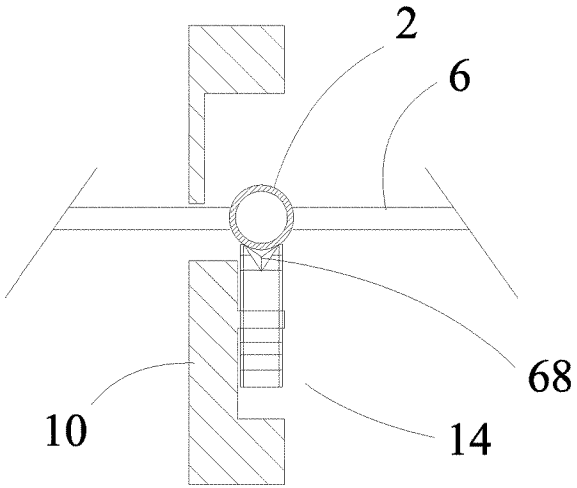
FIG. 5B is a cross section view of a self-centering anti-dry firing device for a crossbow with a cover removed, wherein an arrow is inserted, in accordance with the present invention.
Figure 5A:
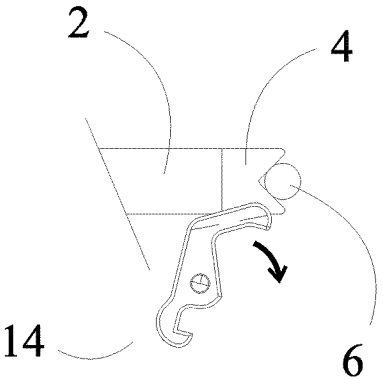
FIG. 5A is a side view of a self-centering anti-dry firing device for a crossbow, wherein an arrow is engaged, in accordance with the present invention.

With reference now to the drawings, and particularly to FIGS. 1-2, there are shown views of a crossbow 100 including a combination anti-dry fire and seer lock lever with self centering (improved seer lock lever) 14. The crossbow 100 includes a riser 102, a barrel 104, two bow limbs 106, two cams 108, a bow string 6, a stock 112 and a trigger housing 10. The two bow limbs 106 extend from opposing ends of the riser 102. The stock 112 extends from one end of the barrel 104. The riser 102 is attached to the barrel 104 in front of the stock 112. Each bow limb 106 is terminated with one of the two cams 108. The bow string 6 is retained on the two cams 108. The trigger housing 10 is contained within the stock 112. The improved seer lock lever 14 is located in the trigger housing 10.

Figure 6:
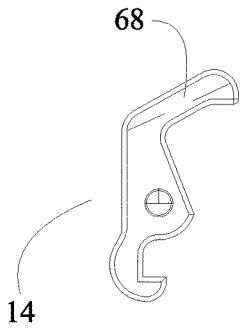
FIG. 6 is a side view of a combination anti-dry fire and seer lock device with self-centering of a self-centering anti-dry firing device for a crossbow in accordance with the present invention.
Figure 6A:
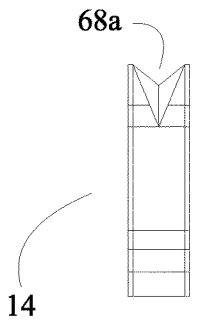
FIG. 6A is a front view of a combination anti-dry fire and seer lock device of a self-centering anti-dry firing device for a crossbow, having a "V" type recess, with self centering in accordance with the present invention.
Figure 6B:
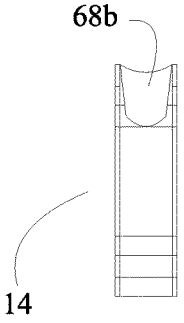
FIG. 6B is a front view of a combination anti-dry fire and seer lock device of a self-centering anti-dry firing device for a crossbow, having a radius type recess, with self centering in accordance with the present invention.
Figure 6C:
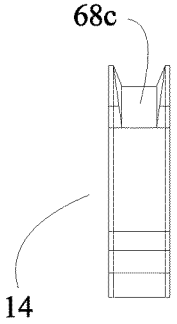
FIG. 6C is a front view of a combination anti-dry fire and seer lock device of a self-centering anti-dry firing device for a crossbow in accordance with the present invention.
Figure 7:
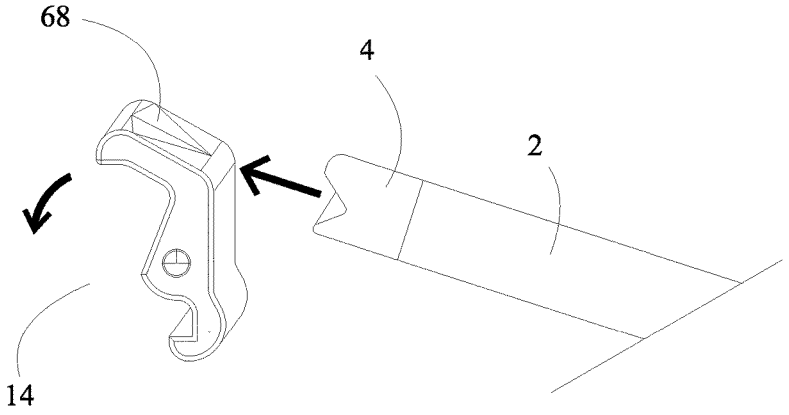
FIG. 7 is a perspective view of a combination anti-dry fire and seer lock device with self-centering having a notch, adjacent an arrow shaft with a nock inserted into the arrow shaft in accordance with the present invention.

With reference to FIGS. 3-5B, the improved crossbow lock mechanism preferably includes the trigger housing 10, a seer lever 12, the improved seer lock lever 14, a string latch 16, a trigger 18 and a safety slide bar 20. With reference to FIGS. 6-7, the improved seer lock lever 14 may use any shape of self-centering arrow cavity 68 formed in an upper surface to self-center an arrow 2, such as a "V" shaped cross section 68*a*, a curved cross sectional shape 68*b*, a notch shaped cross section 68*c* and any other suitable shape. The "V" shaped cross section 68*a* gradually deepens and widens the further the arrow shaft 2 is inserted into the arrow cavity 68. The arrow 2 is retained on the bow string 6 with a nock 4.

A mechanism cavity 26 is formed in the trigger housing 10 to receive and retain the seer lever 12, the improved seer lock lever 14, the string latch 16 and the safety slide bar 20. The seer lever 12 includes a seer base 28, an anti-dry firing projection 30, a latch projection 32, and an elongated pivot link 34. The anti-dry firing projection 30 extends from one end of the seer base 28 and the elongated pivot link 34 extends from an opposing end of the seer base 28, substantially perpendicular to the seer base 28. The latch projection 32 extends outward from a length of the seer base 28. One end of the pivot link 34 is pivotally retained in the mechanism cavity 26 with a seer pivot pin 36. A seer compression spring 35 is retained in a seer spring cavity 37. The seer compression spring 35 biases the seer lever 12 toward the string latch 16. The trigger 18 includes a trigger lever 38 and a trigger link 40. An end of the trigger lever 38 is pivotally retained on the barrel 104 with a fastener 42 or the like. The trigger link 40 includes an elongated body 44 and an end leg 46. The end leg 46 preferably extends outward from one end of the elongated body 44 at an obtuse angle. An opposing end of the elongated pivot link 34 is pivotally retained by an end of the end leg 46 with a pivot pin 48. An opposing end of the trigger link 44 is pivotally retained on the trigger lever 38, adjacent the fastener 42 with a pivot pin 50.

The string latch 16 preferably includes a seer notch 56 and a spring projection 58. The string latch 16 retains the bow string 6 in a safety latch position and releases the bow string 6 in a fire latch position. The arrow shaft yoke 54 extends from one side of the latch base 52 and the spring projection 58 extends from an opposing side of the latch base 52 at one end thereof. The seer notch 56 is formed on the one side of the latch base 52 and the latch foot 60 is formed on the opposing side of the latch base 52 at an opposing end thereof. The one end of the latch base 52 is pivotally retained in the mechanism cavity 26 with a pivot pin 62, adjacent the spring projection 58. A latch spring 64 is retained in a latch spring cavity 67. The latch spring 64 contacts the spring projection 58 and biases the latch foot 60 to contact the latch projection 32.

The improved seer lock lever 14 includes a latch finger 66 and a self-centering arrow cavity 68. The improved seer lock lever 14 is retained in the mechanism cavity 26 with a pivot pin 69. The latch finger 66 extends from a bottom of the improved seer lock lever 14 and the self-centering arrow cavity 68 is formed in a top surface of the improved the seer lock lever 14. The latch finger 66 is sized to capture the anti-dry firing projection 30. Insertion of an arrow 2 into the crossbow 100 and over the self-centering arrow cavity 68 of the improved seer lock lever 14 causes the arrow 2 to self-center, and the latch finger 66 of the improved seer lock lever 14 to pivot and release the anti-dry firing projection 30 of the seer lever 12. A lock spring 70 is retained in a lock spring cavity 71. The lock spring 70 biases the latch finger 66 toward the anti-dry firing projection 30.

A seer lever stop 72 extends outward from the mechanism cavity 26 in the trigger housing 10, above the seer base 28 and between the anti-dry firing projection 30 and the latch projection 32 to stop excessive upward motion of the seer lever 12. The safety slide bar 20 includes a slide pin 78 and a position lock spring 80. A safety detent notch 82 is formed in a top of the safety slide bar 20. A detent ball 84 engages the safe detent notch 82, and is biased toward the safety bar 20 with the position lock spring 80. The position lock spring 80 is retained in a position lock cavity 81. The slide pin 78 is pressed through the safety slide bar 20 to be shuttled between a safe position and a fire position. The safety slide bar 20 is maintained in the safe position by the position lock spring 80 forcing the detent ball 84 into the safe detent notch 82. The safety slide bar 20 is maintained in the fire position, through friction, by the position lock spring 80 forcing the detent ball 84 on to the upper surface of the safety slide bar 20. When the safety slide bar 20 is moved from the fire position to the safety position, the position lock spring 80 decompresses, and forces the detent ball 84 into the safe detent notch 82, generally creating an audible noise. When the safety bar 20 is moved from the safe position to the fire position, the detent ball 84 is forced upwards, and compresses the lock spring 80 within the position lock cavity 81. This added pressure derived from further compressing the lock spring 80 provides adequate friction between the detent ball 84 and the upper surface of the safety bar 20 to hold the safety slide bar 20 in the fire position, without making an audible sound.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A self-centering anti-dry fire device for a crossbow comprising:

a string latch is capable of holding a string;

a seer lever is in contact with said string latch for preventing a release of the string from said string latch, said seer lever is not in contact with said string latch to allow a release of the string from said string latch; and a seer lock lever includes an arrow cavity formed in a top surface thereof, said seer lock lever is engaged with said seer lever in a non-firing position, said lock lever is not engaged with said seer lever in a fire position, wherein an arrow shaft is retained in said arrow cavity, the arrow shaft is centered by said arrow cavity before firing.

2. The self-centering anti-dry fire device for a crossbow of claim 1 wherein:

said arrow cavity has a "V" shaped cross section.

3. The self-centering anti-dry fire device for a crossbow of claim 1 wherein:

said arrow cavity has a curved cross sectional shape.

4. The self-centering anti-dry fire device for a crossbow of claim 1 wherein:

said arrow cavity has a notch cross sectional shape.

5. The self-centering anti-dry fire device for a crossbow of claim 1 wherein:

said string latch, said seer lever and said seer lock lever are pivotally retained in a trigger housing.

6. A self-centering anti-dry fire device for a crossbow comprising:

a string latch includes a seer notch, said string latch is capable of holding a string;

a seer lever includes a latch projection and an anti-dry firing projection, said latch projection is engaged with said seer notch to prevent a release of the string from said string latch, said latch projection is not in contact with said seer notch to allow a release of the string from said string latch; and a seer lock lever includes an arrow cavity formed in a top surface thereof and a latch finger, said latch finger is engaged with said anti-dry firing projection in a non-firing position, said latch finger is not engaged with said seer lever in a fire position, wherein an arrow shaft is retained in said arrow cavity, the arrow shaft is centered by said arrow cavity before firing.

7. The self-centering anti-dry fire device for a crossbow of claim 6 wherein:

said arrow cavity has a "V" shaped cross section.

8. The self-centering anti-dry fire device for a crossbow of claim 6 wherein:

said arrow cavity has a curved cross sectional shape.

9. The self-centering anti-dry fire device for a crossbow of claim 6 wherein:

said arrow cavity has a notch cross sectional shape.

10. The self-centering anti-dry fire device for a crossbow of claim 6 wherein:

said string latch, said seer lever and said seer lock lever are pivotally retained in a trigger housing.

11. A self-centering anti-dry fire device for a crossbow comprising:

a string latch is capable of holding a string;

a seer lever is in contact with said string latch for preventing a release of the string from said string latch, said seer lever is not in contact with said string latch to allow a release of the string from said string latch;

a seer lock lever includes an arrow cavity formed in a top surface thereof, said seer lock lever is engaged with said seer lever in a non-firing position, said lock lever is not engaged with said seer lever in a fire position, wherein an arrow shaft is retained in said arrow cavity, the arrow shaft is centered by said arrow cavity before firing; and a trigger is engaged with said seer lever, wherein pulling said trigger releases said string latch.

12. The self-centering anti-dry fire device for a crossbow of claim 11 wherein:

said arrow cavity has a "V" shaped cross section.

13. The self-centering anti-dry fire device for a crossbow of claim 11 wherein:

said arrow cavity has a curved cross sectional shape.

14. The self-centering anti-dry fire device for a crossbow of claim 11 wherein:

said arrow cavity has a notch cross sectional shape.

15. The self-centering anti-dry fire device for a crossbow of claim 11 wherein:

said string latch, said seer lever, said seer lock lever and said trigger are pivotally retained in a trigger housing.

* * * * *